United States Patent [19]

Warner et al.

[11] Patent Number: 4,951,587

[45] Date of Patent: Aug. 28, 1990

[54] RECOVERY SYSTEM FOR A TRAINING TORPEDO

[75] Inventors: Dwight J. Warner, Chaska; Wayne B. Christenson, Minnetonka, both of Minn.

[73] Assignee: Honeywell Inc., Minneapolis, Minn.

[21] Appl. No.: 391,348

[22] Filed: Aug. 9, 1989

[51] Int. Cl.[5] ..... F42B 19/42

[52] U.S. Cl. ..... 114/20.1; 114/331

[58] Field of Search ..... 114/20.1, 330, 331

[56] References Cited

U.S. PATENT DOCUMENTS

| | | | |
|---|---|---|---|
| 1,035,021 | 8/1912 | Laubeuf | 114/331 |
| 1,097,700 | 5/1914 | Whiting | 114/331 |
| 3,004,507 | 10/1961 | Abrams | 114/20.1 |
| 3,141,434 | 7/1964 | Van Billiard | 114/20.1 |
| 3,153,394 | 10/1964 | Shaver et al. | 114/20.1 |
| 3,404,649 | 10/1968 | Valihora | 114/20.1 |
| 3,444,341 | 5/1969 | Mighton | 200/82 C |
| 3,619,526 | 11/1971 | Riley | 200/83 J |
| 3,683,835 | 8/1972 | Deslierres | 114/331 |
| 3,884,150 | 5/1975 | Brennan | 102/416 |
| 4,271,552 | 6/1981 | Sandler | 114/20.1 |
| 4,542,694 | 9/1985 | Wells | 102/229 |
| 4,706,596 | 11/1987 | Charvin et al. | 114/312 |

OTHER PUBLICATIONS

"Honeywell Operational Training Torpedo" advertisement.

*Primary Examiner*—David H. Brown

*Attorney, Agent, or Firm*—John G. Shudy, Jr.; Roger W. Jensen

[57] ABSTRACT

A recovery apparatus for a training torpedo built to replicate an operational torpedo. The training torpedo is an elongated hollow housing substantially similar in shape to an operational torpedo. The nose portion is a shell having a forward and aft portion, the forward portion being a cylindrical cavity extending longitudinally into the shell. A cylindrically shaped piston is adapted to be inserted into cylindrical cavity of the shell. The piston has a forward and a rear portion, the forward portion being a pressure receiving surface. The piston is able to move forward and aft with respect to the shell. Attached to the piston is a retaining means. When a pressure is imposed upon the forward portion of the piston the piston moves aft and the retaining means releases a plurality of weights. Located between the piston and the shell is a damping means. The damping means acts as a counter force to the pressure on the pressure receiving surface of the piston.

6 Claims, 3 Drawing Sheets

RECOVERY SYSTEM FOR A TRAINING TORPEDO

BACKGROUND

This invention relates to a pressure activated release system for training torpedoes to facilitate their recovery after launch for future use. It is necessary for a military force to practice firing the weapons they must use in battle. However the use of live rounds would be very expensive, thus limiting training. This promotes the need for a training torpedo that will match the pre-launch characteristics of a standard torpedo, yet still is recoverable. The torpedo must be designed with the following features reliability, maintainability, durability and it must be reusable. Our invention provides all of these design features in an effective manner.

The training torpedo utilizing our invention is designed to be fired from the same launch platform as a standard torpedo. Prior to launch the torpedo exhibits the same characteristics as a standard torpedo; the characteristics being external dimensions, weight, center of gravity, launch accessories, tools, and loading and handling equipment. As a standard torpedo is denser than water, the training torpedo having the same characteristics would sink in water, making recovery difficult. Our invention is designed such that when a fluid pressure is imposed upon the nose section of the torpedo, a plurality of weights are released. This substantially reduces the density of the device making it less dense than water and thus allowing buoyancy forces to float the training torpedo to the surface.

Our invention is a fluid pressure activated device, henceforth pressure will be considered to be fluid pressure, activated by impact pressure, dynamic pressure or static pressure. Prior art show many pressure activated devices. These devices vary from hydrostatic delay action fuses to miniature pneumatic switch actuators. The majority of these devises are complex in nature and none of them completely meet the desired design requirements. Therefore it was necessary to devise a new method of releasing the weights.

SUMMARY OF THE INVENTION

Our invention is a recovery apparatus for a training torpedo built to replicate an operational torpedo. The training torpedo has an elongated hollow housing substantially similar in shape to the operational or standard torpedo, such that it has a density less than water when the aforesaid weights are released. Our invention meets all of the aforementioned desired design requirements. It comprises in part a substantially cylindrically shaped piston located in the nose of the training torpedo. The piston has a pressure receiving surface suited to react to the three previously mentioned fluid pressures. The piston having a longitudinal axis in alignment with or parallel to the longitudinal axis of the training torpedo is mounted for movement along its longitudinal axis in response to a single or the combination of impact, dynamic or static pressures applied to the pressure receiving surface. The nose portion of the training torpedo is a shell with a forward and aft portion, the forward portion having a cylindrical cavity extending longitudinally into the shell. The above mentioned piston is adapted to be inserted into cylindrical cavity of the shell. The piston has a forward and a rear portion, the forward portion being the pressure receiving surface. Attached to the piston is a retaining means; when a pressure is imposed upon the forward portion of the piston the piston moves aft and the retaining means releases a plurality of weights. Located between the piston and the shell is a damping means. The damping means acts as a counter force to the pressure on the pressure receiving surface of the piston.

PREFERRED EMBODIMENT OF THE INVENTION

Figure 1:
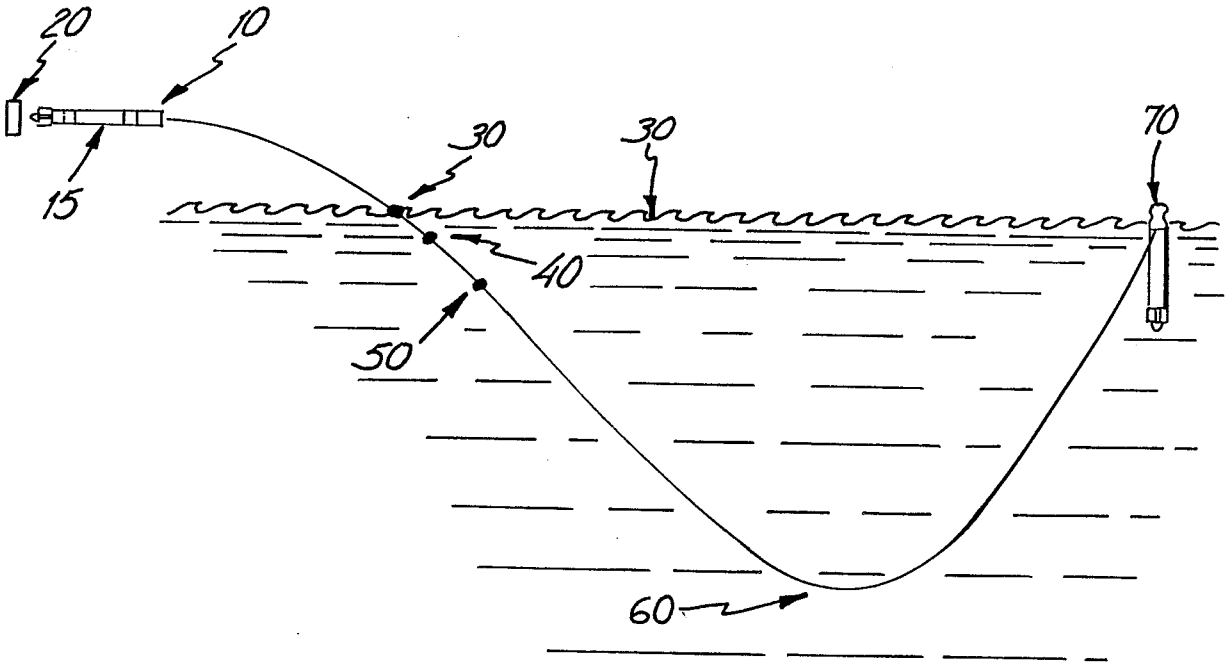
FIG. 1 illustrates the invention in use.

In FIG. 1 the reference numeral 10 generally designates a pressure release system which utilizes our invention. The apparatus 10 comprises the nose section of a training torpedo 15 adapted to be launched from a launch platform 20, e.g., an aircraft or ship. Upon the training torpedo entering the water 30, an impact pressure is exerted upon the forward face of the piston. In addition to the impact pressure, dynamic pressures due to the forward motion of the device is exerted upon the face of the piston. When a sufficient force is exerted upon the piston, at position 40, the invention 10 releases the weights. If the impact and dynamic pressures are not sufficient to release the weights the training torpedo will sink until a sufficient static pressure is achieved. The weights, no longer being affixed to the nose portion of the torpedo, fall away at position 50. The torpedo momentum causes additional travel to a maximum depth 60, where buoyancy force float the torpedo to the surface at position 70.

Using the invention as described above allows naval personal to fire torpedoes that simulate a live torpedo, yet cost less and are recoverable. The simplicity of the invention allows the crews to recover the device, reset the trigger, install new weights and fire the device within an hour.

Figure 2:
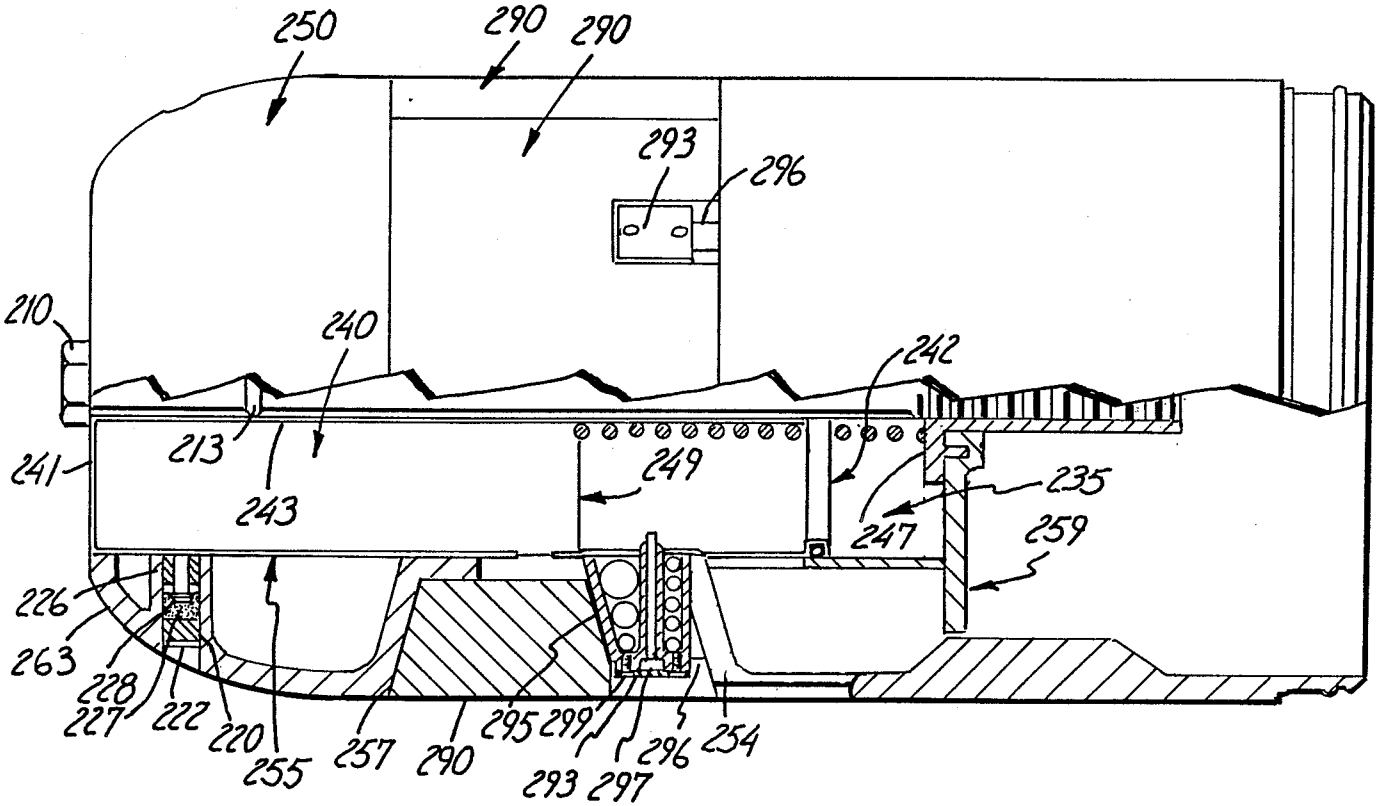
FIG. 2 demonstrates the operation of the invention.

FIG. 2 is a cut away drawing of the nose portion of the recovery apparatus. The top portion being the outer view of the device, the bottom half being a cut away view of the inner workings of the apparatus. In the apparatus, the piston is identified by reference numeral 240 having a front or forward pressure receiving surface 241 and an aft end 242. The piston has a longitudinally extending central bore 243 therethrough, piston retaining bolt 210 is inserted through the central bore 243 of the piston 240 to limit the longitudinal range of the piston 240. The piston 240 for this embodiment is cylindrically shaped and adapted to be inserted into a shell 250.

The shell 250 is in the shape of the nose portion of a torpedo. The shell 250 has a cylindrical cavity 255 extending longitudinally into the front portion 253 of the shell 250. The shell 250 is further characterized by a groove 257 that encircles the midsection of the shell 250. A plurality of lead weights 290, in this case six, are placed in the groove 257. The weights 290 have a notch 296 in their rear portion with respect to the shell 250. The notch 296 is a "T" in shape, with the top of the "T" being placed away from the shell 250. The weights 290 are affixed to the shell 250 with lead weight retaining plates 293. The weights 290 are of a shape complementary to the shell 250, when the weights 290 are inserted into the shell 250, the shell-weight 250–290 configuration is substantially similar in form to the nose of a standard torpedo.

The aforesaid piston retaining bolt 210 is anchored into the bulkhead 259 of the torpedo such that the retaining bolt 210 will limit the range of longitudinal motion for the piston 240. The piston retaining bolt 2!0 is extends longitudinally through a compression spring 215 located between the piston 240 and the bulkhead 259. The spring 2!5 exerts a force on a rear surface 249 of the piston 240, keeping the piston 240 in the forward position prior to launch. The spring 215 may be selected such that the force releasing the weights 290 may be predetermined.

Two seals are placed on the invention. The first seal 247 is located on the piston 240, near the rear portion 242 of the piston 240 and encircling the side of the piston 240. The second seal 213 is placed on the piston retaining bolt 210, for the preferred embodiment "parker u packing seals" are used. These seals 213 and 247 are used to prevent the environment from entering the shell 250. This creates a sealed air cavity 235, such that pressure between the bulkhead 259 and the piston 240 is substantially the same when in use as it is prior to firing.

Affixed to the piston 240 are the piston wings 95, the piston wing 295 extends from the piston 240, through the shell 250, and out through the center of the notch 296. The piston wing 295 is fastened to the piston 240 with a first bolt 297 that extends through the piston wing 295 and into the piston 240. The aforementioned weight retaining plate 293 is attached to the outer most portion of the piston wing 295 with respect to the piston 240. The piston wing 295 and weight retaining plate 293 form a "T" substantially similar to the "T" 296 of the weight 290. The weight retaining plates 293 are fastened to the piston wings 295 with bolts 299. The shell 250 is further adapted with a slot 254 of the same dimensions and shape as the "T" 296 of the Weights 290. The piston wing 295 and the weight retaining plate 293 are configured such that when the piston 240 moves rearward the piston wing 295 and the weight retaining plate 293 slide into the slot 254 and no longer retain the weights 290. The weights 290 are then free to fall away from the torpedo and the torpedo may float to the surface.

The device is also fitted with a piston lock assembly 220. The piston lock assembly 220 is located in the forward portion of the shell 253 and consists of a piston lock pin 228, a compression spring 227, a piston lock pin sleeve 226, and a piston lock pin sleeve cap 222. The piston lock 220 rides the side of the piston 240 and is spring loaded. When the piston 240 moves to its rear most position, the piston lock pin 228 is forced out in front of the piston 240 by compression spring 227. This locks the piston 240 in its rear most position and keeps the piston wing 295 and weight retaining plate 293 in the slot 254. By adding the piston lock assembly 220, the weights 290 will release when the piston 240 reaches its rear most position with out the compression spring 215 being able to force the piston 240 forward, thus preventing the piston wing 295 or the weight retaining plate 293 from retaining any of the weights 290.

Figure 3C:
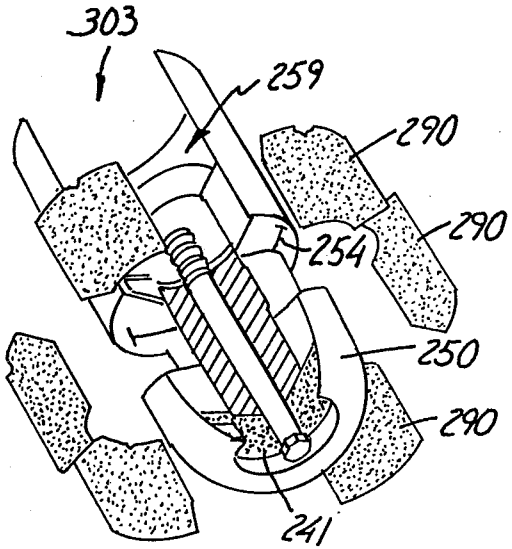
Figure 3B:
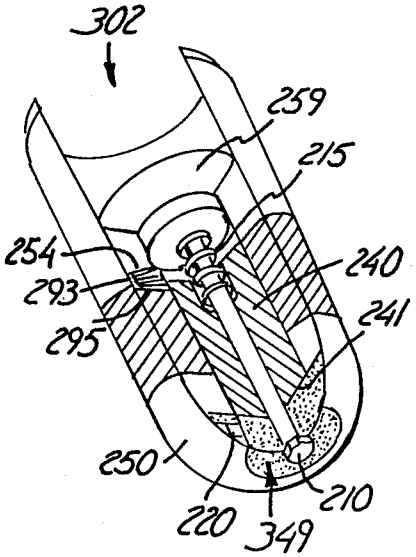
Figure 3A:
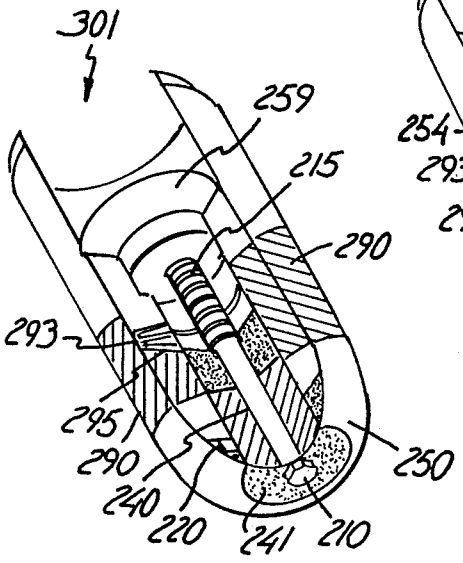

In FIG. 3*a* the invention as shown in FIG. 2 is designated as 301, and shows the invention prior to launch. The piston 240 is flush with the front of the shell 250, the piston lock assemblies 220 are in their cocked positions, and the weights 290 are retained. The second embodiment shown in FIG. 3*b* designated 302 shows a pressure 349 acting on the pressure receiving surface 241 of the piston 240 and moving the piston 240 to its rear most position, which places the piston wings 295 and the weight retaining plates 293 inside the slot 254 in the shell 250. This removes the retaining means from the weights 290 and allows them to fall away from the shell 250 as shown in FIG. 3*c*. The piston lock assembly 220 has locked the piston 240 in this position thus preventing the weight retaining plates 293 from interfering with the weights 290.

The simplicity of the device as illustrated above makes it possible for a military unit to fire the training torpedo, retrieve it and fire it again within hours. The embodiment shown uses the same tools as a standard torpedo, making it cost effective. In general this invention meets the previously stated design requirements.

We claim:

1. A recovery apparatus for a training torpedo, said training torpedo being an elongated hollow cylindrical housing replicating the housing of an operational torpedo with a nose portion and an aft portion, said recovery apparatus comprising:

(a) a cylindrical shell, said shell comprising said nose portion of said training torpedo and having forward and aft sections, said forward section having a centrally located cylindrical cavity extending longitudinally into said shell;

(b) a piston with a front portion and a rear portion, said front portion having a pressure receiving surface, said piston being adapted to be inserted into said cylindrical cavity, and said piston being movable forward and aft with respect to said shell;

(c) a retaining means attached to said piston and to a plurality of weights, said retaining means releasing said weights upon said piston moving aft a preselected distance with respect to said shell; and (d) a damping means located between said rear portion of said piston and said aft section of said shell, said damping means acting as a counter force with respect to said pressure on said forward portion of said piston.

2. The apparatus of claim 1 where said retaining means is a piston wing with a weight retaining plate, said piston wing being affixed to said piston and said weight retaining plate being mounted on the outer most portion of said piston wing with respect to said piston.

3. The apparatus of claim 1 further characterized by a piston retaining bolt extending longitudinally through said piston and affixing to said aft section of said shell, whereby said retaining bolt maintains a constant longitudinal range of motion for said piston.

4. The apparatus of claim 3 further characterized by said damping means being a spring, wherein said retaining bolt extends longitudinally through said spring.

5. The apparatus of claim 4 where said retaining means is a piston wing with a weight retaining plate, said piston wing being affixed to said piston and said weight retaining plate being mounted on the outer most portion of said piston wing with respect to said piston.

6. The apparatus of claim 5 further characterized by a piston lock pin, said piston lock pin preventing the forward motion of said piston upon said piston moving aft with respect to said shell.

* * * * *

UNITED STATES PATENT AND TRADEMARK OFFICE

CERTIFICATE OF CORRECTION

PATENT NO. : 4,951,587

DATED : August 28, 1990

INVENTOR(S) : DWIGHT J. WARNER and WAYNE B. CHRISTENSON

It is certified that error appears in the above-identified patent and that said Letters Patent is hereby corrected as shown below:

Column 3, line 6, cancel "2!0" and substitute --210--;
line 9, cancel "2!5" and substitute --215--;
line 25, cancel "95" and substitute --295--;
line 38, cancel "Weights" and substitute --weights--.

Signed and Sealed this

Fourth Day of February, 1992

*Attest:*

HARRY F. MANBECK, JR.

*Attesting Officer*

*Commissioner of Patents and Trademarks*